US008894437B2

(12) United States Patent
Adams et al.

(10) Patent No.: US 8,894,437 B2
(45) Date of Patent: Nov. 25, 2014

(54) SYSTEMS AND METHODS FOR CONNECTOR ENABLING VERTICAL REMOVAL

(75) Inventors: Glen Adams, Torrington, CT (US); Robin Kelley, Douglas, MA (US); David Farnsworth, New Ipswich, NH (US); Charles Bernard Valois, Westford, MA (US); Thomas Lawrence Zampini, II, Concord, MA (US)

(73) Assignee: Integrated Illumination Systems, Inc., Morris, CT (US)

( * ) Notice: Subject to any disclaimer, the term of this patent is extended or adjusted under 35 U.S.C. 154(b) by 27 days.

(21) Appl. No.: 13/553,666

(22) Filed: Jul. 19, 2012

(65) Prior Publication Data

US 2014/0024249 A1 Jan. 23, 2014

(51) Int. Cl.
*H01R 31/08* (2006.01)

(52) U.S. Cl.
USPC ..... 439/509; 439/512

(58) Field of Classification Search
CPC ..... H01R 31/02; H01R 31/08; H01R 31/085; F21Y 2101/02
USPC ..... 439/507–513; 362/249.02
See application file for complete search history.

(56) References Cited

U.S. PATENT DOCUMENTS

| | | | | |
|---|---|---|---|---|
| 4,139,770 | A | 2/1979 | Beyersdorf | |
| 5,257,941 | A * | 11/1993 | Lwee et al. | 439/65 |
| 5,264,997 | A | 11/1993 | Hutchisson et al. | |
| 5,465,199 | A | 11/1995 | Bray et al. | |
| 5,561,346 | A | 10/1996 | Byrne | |
| 5,659,582 | A | 8/1997 | Kojima et al. | |
| 5,711,681 | A * | 1/1998 | Hasegawa | 439/86 |
| 5,783,909 | A | 7/1998 | Hochstein | |
| 5,803,579 | A | 9/1998 | Turnbull et al. | |
| 5,909,429 | A | 6/1999 | Satyanarayana et al. | |
| 5,947,587 | A | 9/1999 | Keuper et al. | |
| 6,013,988 | A | 1/2000 | Bucks et al. | |
| 6,016,038 | A | 1/2000 | Mueller et al. | |
| 6,040,663 | A | 3/2000 | Bucks et al. | |
| 6,094,014 | A | 7/2000 | Bucks et al. | |
| 6,127,783 | A | 10/2000 | Pashley et al. | |

(Continued)

FOREIGN PATENT DOCUMENTS

WO WO-03/017733 A1 2/2003

OTHER PUBLICATIONS

"1-Wire Products Deliver a Powerful Combination . . . ", Mixed-Signal Design Guide, Dallas Semiconductor Maxim, 2005, 7 pages.
"Conductivity with the BS2/OWL2", EME Systems, 2002, pp. 1-3.

(Continued)

*Primary Examiner* — Thanh Tam Le
(74) *Attorney, Agent, or Firm* — Foley & Lardner LLP; Christopher J. McKenna

(57) ABSTRACT

Apparatus and related methods for serially and removably connecting a plurality of electrical fixtures. An exemplary apparatus includes a connector housing having a mounting surface, a first set of electrical contacts positioned, at least in part, in the connector housing, a second set of electrical contacts positioned, at least in part, in the connector housing, and a plurality of conductive member extending from the first set of electrical contacts to the second set of electrical contacts, such that a first electrical fixture removably connected to the first set of electrical contacts is in serial electrical communication with a second electrical fixture removably connected to the second set of electrical contacts.

13 Claims, 10 Drawing Sheets

(56) References Cited

U.S. PATENT DOCUMENTS 6,147,458 A 11/2000 Bucks et al.
6,150,774 A 11/2000 Mueller et al.
6,157,093 A 12/2000 Giannopoulos et al.
6,166,496 A 12/2000 Lys et al.
6,194,839 B1 2/2001 Chang
6,201,353 B1 3/2001 Chang et al.
6,211,626 B1 4/2001 Lys et al.
6,234,645 B1 5/2001 Borner et al.
6,234,648 B1 5/2001 Borner et al.
6,236,331 B1 5/2001 Dussureault
6,238,065 B1 5/2001 Jones
6,249,088 B1 6/2001 Chang
6,250,774 B1 6/2001 Begemann et al.
6,253,530 B1 7/2001 Price et al.
6,288,497 B1 9/2001 Chang et al.
6,292,901 B1 9/2001 Lys et al.
6,299,329 B1 10/2001 Mui et al.
6,304,464 B1 10/2001 Jacobs et al.
6,305,818 B1 10/2001 Lebens et al.
6,340,864 B1 1/2002 Wacyk
6,340,868 B1 1/2002 Lys et al.
6,384,545 B1 5/2002 Lau
6,386,733 B1 * 5/2002 Ohkohdo et al. ..... 362/249.06
6,411,046 B1 6/2002 Muthu
6,441,558 B1 8/2002 Muthu et al.
6,443,592 B1 9/2002 Unger et al.
6,445,139 B1 9/2002 Marshall et al.
6,459,919 B1 10/2002 Lys et al.
6,489,731 B1 12/2002 Bruning et al.
6,495,964 B1 12/2002 Muthu et al.
6,507,158 B1 1/2003 Wang
6,507,159 B2 1/2003 Muthu
6,510,995 B2 1/2003 Muthu et al.
6,513,949 B1 2/2003 Marshall et al.
6,528,954 B1 3/2003 Lys et al.
6,552,495 B1 4/2003 Chang
6,576,881 B2 6/2003 Muthu et al.
6,577,080 B2 6/2003 Lys et al.
6,577,512 B2 6/2003 Tripathi et al.
6,580,309 B2 6/2003 Jacobs et al.
6,586,890 B2 7/2003 Min et al.
6,596,977 B2 7/2003 Muthu et al.
6,608,453 B2 8/2003 Morgan et al.
6,609,813 B1 8/2003 Showers et al.
6,617,795 B2 9/2003 Bruning
6,621,235 B2 9/2003 Chang
6,630,801 B2 10/2003 Schuurmans
6,636,003 B2 10/2003 Rahm et al.
6,639,368 B2 10/2003 Sheoghong
6,676,284 B1 1/2004 Wynne
6,692,136 B2 2/2004 Marshall et al.
6,720,745 B2 4/2004 Lys et al.
6,724,159 B2 4/2004 Gutta et al.
6,734,639 B2 5/2004 Chang et al.
6,741,351 B2 5/2004 Marshall et al.
6,762,562 B2 7/2004 Leong
6,777,891 B2 8/2004 Lys et al.
6,788,011 B2 9/2004 Mueller et al.
6,796,680 B1 9/2004 Showers et al.
6,796,686 B2 9/2004 Jacob et al.
6,801,003 B2 10/2004 Schanberger et al.
6,806,659 B1 10/2004 Mueller et al.
6,831,569 B2 12/2004 Wang et al.
6,853,150 B2 2/2005 Clauberg et al.
6,853,151 B2 2/2005 Leong et al.
6,859,644 B2 2/2005 Wang
6,922,022 B2 7/2005 Bucks et al.
6,930,452 B2 8/2005 De Krijger et al.
6,932,477 B2 8/2005 Stanton
6,933,685 B2 8/2005 Gutta et al.
6,933,767 B2 8/2005 Bucks et al.
6,965,205 B2 11/2005 Piepgras et al.
6,969,954 B2 11/2005 Lys
6,972,525 B2 12/2005 Bucks et al.
6,975,079 B2 12/2005 Lys et al.
6,992,803 B2 1/2006 Chang
6,998,594 B2 2/2006 Gaines et al.
7,014,336 B1 3/2006 Ducharme et al.
7,030,572 B2 4/2006 Nijhof et al.
7,031,920 B2 4/2006 Dowling et al.
7,038,398 B1 5/2006 Lys et al.
7,038,399 B2 5/2006 Lys et al.
7,064,498 B2 6/2006 Dowling et al.
7,067,992 B2 6/2006 Leong et al.
7,071,762 B2 7/2006 Xu et al.
7,113,541 B1 9/2006 Lys et al.
7,118,248 B2 10/2006 Wynne
7,132,804 B2 11/2006 Lys et al.
7,135,824 B2 11/2006 Lys et al.
7,139,617 B1 11/2006 Morgan et al.
7,140,752 B2 11/2006 Ashdown
7,161,311 B2 1/2007 Mueller et al.
7,161,313 B2 1/2007 Piepgras et al.
7,161,556 B2 1/2007 Morgan et al.
7,178,941 B2 2/2007 Roberge et al.
7,180,252 B2 2/2007 Lys et al.
7,186,003 B2 3/2007 Dowling et al.
7,202,608 B2 4/2007 Robinson et al.
7,202,613 B2 4/2007 Morgan et al.
7,202,641 B2 4/2007 Claessens et al.
7,204,622 B2 4/2007 Dowling et al.
7,221,104 B2 5/2007 Lys et al.
7,228,190 B2 6/2007 Dowling et al.
7,231,060 B2 6/2007 Dowling et al.
7,233,115 B2 6/2007 Lys
7,233,831 B2 6/2007 Blackwell
7,242,152 B2 7/2007 Dowling et al.
7,253,566 B2 8/2007 Lys et al.
7,255,457 B2 8/2007 Ducharme et al.
7,255,458 B2 8/2007 Ashdown
7,256,554 B2 8/2007 Lys
7,262,559 B2 8/2007 Tripathi et al.
7,267,461 B2 9/2007 Kan et al.
7,274,160 B2 9/2007 Mueller et al.
7,300,192 B2 11/2007 Mueller et al.
7,308,296 B2 12/2007 Lys et al.
7,309,965 B2 12/2007 Dowling et al.
7,314,289 B2 1/2008 Montagne
7,319,298 B2 1/2008 Jungwirth et al.
7,323,676 B2 1/2008 Duijve
7,329,998 B2 2/2008 Jungwirth
7,350,936 B2 4/2008 Ducharme et al.
7,352,138 B2 4/2008 Lys et al.
7,352,339 B2 4/2008 Morgan et al.
7,353,071 B2 4/2008 Blackwell et al.
7,354,172 B2 4/2008 Chemel et al.
7,358,679 B2 4/2008 Lys et al.
7,358,681 B2 4/2008 Robinson et al.
7,358,706 B2 4/2008 Lys
7,358,929 B2 4/2008 Mueller et al.
7,358,961 B2 4/2008 Zwanenburg
7,387,405 B2 6/2008 Ducharme et al.
7,388,665 B2 6/2008 Ashdown
7,394,210 B2 7/2008 Ashdown
7,420,335 B2 9/2008 Robinson et al.
7,423,387 B2 9/2008 Robinson et al.
7,432,668 B2 10/2008 Zwanenburg et al.
7,443,209 B2 10/2008 Chang
7,449,847 B2 11/2008 Schanberger et al.
7,453,217 B2 11/2008 Lys et al.
7,459,864 B2 12/2008 Lys
7,462,997 B2 12/2008 Mueller et al.
7,463,070 B2 12/2008 Wessels
7,481,671 B1 * 1/2009 Farole et al. ..... 439/507
7,482,565 B2 1/2009 Morgan et al.
7,482,760 B2 1/2009 Jungwirth et al.
7,488,200 B2 * 2/2009 Yamamoto et al. ..... 439/511
7,490,953 B2 2/2009 Holten et al.
7,490,957 B2 2/2009 Leong et al.
7,495,671 B2 2/2009 Chemel et al.
7,502,034 B2 3/2009 Chemel et al.
7,505,395 B2 3/2009 Ashdown et al.
7,507,001 B2 3/2009 Kit
7,507,124 B2 * 3/2009 Kim ..... 439/627

(56) References Cited

U.S. PATENT DOCUMENTS 7,511,436 B2 3/2009 Xu
7,511,437 B2 3/2009 Lys et al.
7,515,128 B2 4/2009 Dowling
7,520,634 B2 4/2009 Ducharme et al.
7,520,775 B2 * 4/2009 Wu et al. ..... 439/507
7,521,872 B2 4/2009 Bruning
7,525,254 B2 4/2009 Lys et al.
7,538,499 B2 5/2009 Ashdown
7,542,257 B2 6/2009 McCormick et al.
7,550,931 B2 6/2009 Lys et al.
7,550,935 B2 6/2009 Lys et al.
7,557,521 B2 7/2009 Lys
7,569,807 B2 8/2009 Matheson
7,572,028 B2 8/2009 Mueller et al.
7,573,209 B2 8/2009 Ashdown et al.
7,573,210 B2 8/2009 Ashdown et al.
7,573,729 B2 8/2009 Elferich et al.
7,598,681 B2 10/2009 Lys et al.
7,598,684 B2 10/2009 Lys et al.
7,598,686 B2 10/2009 Lys et al.
7,618,283 B1 * 11/2009 Costello ..... 439/511
7,619,370 B2 11/2009 Chemel et al.
7,652,236 B2 1/2010 Cortenraad et al.
7,654,703 B2 2/2010 Kan et al.
7,656,366 B2 2/2010 Ashdown
7,658,506 B2 2/2010 Dowling
7,659,673 B2 2/2010 Lys
7,659,674 B2 2/2010 Mueller et al.
7,665,883 B2 2/2010 Matheson
7,667,409 B2 2/2010 Geerts et al.
7,675,238 B2 3/2010 Cortenraad et al.
7,687,753 B2 3/2010 Ashdown
7,688,002 B2 3/2010 Ashdown et al.
7,689,130 B2 3/2010 Ashdown
7,703,951 B2 4/2010 Piepgras et al.
7,710,369 B2 5/2010 Dowling
7,712,926 B2 5/2010 Matheson
7,713,083 B1 * 5/2010 Sun et al. ..... 439/507
7,714,521 B2 5/2010 Qian
7,731,387 B2 6/2010 Cortenraad et al.
7,731,389 B2 6/2010 Draganov et al.
7,731,390 B2 6/2010 Van Gorkom et al.
7,737,643 B2 6/2010 Lys
7,738,002 B2 6/2010 Ashdown et al.
7,740,375 B2 6/2010 Zou et al.
7,766,489 B2 8/2010 Duine et al.
7,766,518 B2 8/2010 Piepgras et al.
7,772,787 B2 8/2010 Ashdown et al.
7,777,427 B2 8/2010 Stalker, III
7,781,979 B2 8/2010 Lys
7,802,902 B2 9/2010 Moss et al.
7,806,558 B2 10/2010 Williamson
7,808,191 B2 10/2010 Wu
7,809,448 B2 10/2010 Lys et al.
7,810,974 B2 10/2010 Van Rijswick et al.
7,841,860 B1 * 11/2010 Chen ..... 439/65
7,845,823 B2 12/2010 Mueller et al.
7,850,347 B2 12/2010 Speier et al.
7,854,539 B2 12/2010 Van Duijneveldt
7,868,562 B2 1/2011 Salsbury et al.
7,878,683 B2 2/2011 Logan et al.
7,878,688 B2 2/2011 Paulussen et al.
7,893,631 B2 2/2011 Speier
7,893,661 B2 2/2011 Ackermann et al.
7,894,050 B2 2/2011 Ashdown et al.
7,906,917 B2 3/2011 Tripathi et al.
7,911,151 B2 3/2011 Xu
7,914,173 B2 3/2011 Paulussen et al.
7,987,594 B1 * 8/2011 Farole et al. ..... 29/884
8,022,632 B2 9/2011 Schulz et al.
8,026,673 B2 9/2011 Lys
2002/0074559 A1 6/2002 Dowling et al.
2003/0132721 A1 7/2003 Jacobs et al.
2003/0133292 A1 7/2003 Mueller et al.
2004/0052076 A1 3/2004 Mueller et al.
2004/0090191 A1 5/2004 Mueller et al.
2004/0178751 A1 9/2004 Mueller et al.
2005/0236998 A1 10/2005 Mueller et al.
2005/0275626 A1 12/2005 Mueller et al.
2006/0002110 A1 1/2006 Dowling et al.
2006/0076908 A1 4/2006 Morgan et al.
2006/0114201 A1 6/2006 Chang
2006/0152172 A9 7/2006 Mueller et al.
2006/0221606 A1 10/2006 Dowling
2006/0262521 A1 11/2006 Piepgras et al.
2006/0274526 A1 12/2006 Weston et al.
2006/0290624 A1 12/2006 Ashdown
2007/0063658 A1 3/2007 Van Der Veeken
2007/0086912 A1 4/2007 Dowling et al.
2007/0115658 A1 5/2007 Mueller et al.
2007/0145915 A1 6/2007 Roberge et al.
2007/0153514 A1 7/2007 Dowling et al.
2007/0230159 A1 10/2007 Cortenraad et al.
2007/0258240 A1 11/2007 Ducharme et al.
2007/0273290 A1 11/2007 Ashdown et al.
2008/0042599 A1 2/2008 Ashdown
2008/0043464 A1 2/2008 Ashdown
2008/0048582 A1 2/2008 Robinson
2008/0062413 A1 3/2008 Ashdown et al.
2008/0089060 A1 4/2008 Kondo et al.
2008/0094005 A1 4/2008 Rabiner et al.
2008/0122386 A1 5/2008 De Brouwer et al.
2008/0136331 A1 6/2008 Schmeikal
2008/0136796 A1 6/2008 Dowling
2008/0140231 A1 6/2008 Blackwell et al.
2008/0164826 A1 7/2008 Lys
2008/0164854 A1 7/2008 Lys
2008/0167734 A1 7/2008 Robinson et al.
2008/0183081 A1 7/2008 Lys et al.
2008/0239675 A1 10/2008 Speier
2008/0265797 A1 10/2008 Van Doorn
2008/0278092 A1 11/2008 Lys et al.
2008/0278941 A1 11/2008 Logan et al.
2008/0290251 A1 11/2008 Deurenberg et al.
2008/0297066 A1 12/2008 Meijer et al.
2008/0298330 A1 12/2008 Leitch
2008/0315798 A1 12/2008 Diederiks et al.
2009/0002981 A1 1/2009 Knibbe
2009/0021175 A1 1/2009 Wendt et al.
2009/0021182 A1 1/2009 Sauerlaender
2009/0072761 A1 3/2009 Wessels
2009/0128059 A1 5/2009 Joosen et al.
2009/0134817 A1 5/2009 Jurngwirth et al.
2009/0160364 A1 6/2009 Ackermann et al.
2009/0168415 A1 7/2009 Deurenberg et al.
2009/0179587 A1 7/2009 Van Der Veen et al.
2009/0179596 A1 7/2009 Willaert et al.
2009/0189448 A1 7/2009 Verschueren
2009/0224695 A1 9/2009 Van Erp et al.
2009/0230884 A1 9/2009 Van Doorn
2009/0243507 A1 10/2009 Lucero-Vera et al.
2009/0278473 A1 11/2009 Van Erp
2009/0284174 A1 11/2009 Sauerlander et al.
2009/0321666 A1 12/2009 Hilgers
2010/0007600 A1 1/2010 Deurenberg et al.
2010/0026191 A1 2/2010 Radermacher et al.
2010/0045478 A1 2/2010 Schulz et al.
2010/0072901 A1 3/2010 De Rijck et al.
2010/0072902 A1 3/2010 Wendt et al.
2010/0079085 A1 4/2010 Wendt et al.
2010/0079091 A1 4/2010 Deixler et al.
2010/0084995 A1 4/2010 Baaijens et al.
2010/0091488 A1 4/2010 Ijzerman et al.
2010/0094439 A1 4/2010 Van De Meulenhof et al.
2010/0102732 A1 4/2010 Peeters et al.
2010/0117543 A1 5/2010 Van Der Veen et al.
2010/0117656 A1 5/2010 Snelten
2010/0118531 A1 5/2010 Montagne
2010/0127633 A1 5/2010 Geerts et al.
2010/0134041 A1 6/2010 Radermacher et al.
2010/0134042 A1 6/2010 Willaert
2010/0148689 A1 6/2010 Morgan et al.
2010/0164399 A1 7/2010 Radermacher et al.
2010/0165618 A1 7/2010 Vissenberg et al.

(56) References Cited

U.S. PATENT DOCUMENTS

| | | | |
|---|---|---|---|
| 2010/0171771 | A1 | 7/2010 | Otte et al. |
| 2010/0181936 | A1 | 7/2010 | Radermacher et al. |
| 2010/0188007 | A1 | 7/2010 | Deppe et al. |
| 2010/0194293 | A1 | 8/2010 | Deurenberg et al. |
| 2010/0231133 | A1 | 9/2010 | Lys |
| 2010/0231363 | A1 | 9/2010 | Knibbe |
| 2010/0244707 | A1 | 9/2010 | Gaines et al. |
| 2010/0244734 | A1 | 9/2010 | Van Herpen et al. |
| 2010/0259182 | A1 | 10/2010 | Man et al. |
| 2010/0264834 | A1 | 10/2010 | Gaines et al. |
| 2010/0271843 | A1 | 10/2010 | Holten et al. |
| 2010/0289532 | A1 | 11/2010 | Wendt et al. |
| 2010/0301780 | A1 | 12/2010 | Vinkenvleugel |
| 2010/0308745 | A1 | 12/2010 | Delnoij |
| 2011/0025205 | A1 | 2/2011 | Van Rijswick et al. |
| 2011/0025230 | A1 | 2/2011 | Schulz et al. |
| 2011/0035404 | A1 | 2/2011 | Morgan et al. |
| 2011/0042554 | A1 | 2/2011 | Hilgers et al. |
| 2011/0090684 | A1 | 4/2011 | Logan et al. |
| 2011/0095694 | A1 | 4/2011 | Justel et al. |
| 2011/0285292 | A1 | 11/2011 | Mollnow et al. |
| 2011/0291812 | A1 | 12/2011 | Verbrugh |
| 2012/0019670 | A1 | 1/2012 | Chang et al. |

OTHER PUBLICATIONS

"Dimmable Fluorescent Ballast", ATAVRFBKIT/EVLB001, User Guide, ATMEL, 2007, pp. 1-33.
"Understanding Boost Power Stages in Switchmode Power Supplies", Application Report, Texas Instruments, Mixed Signal Products, Mar. 1999, pp. 1-28.
"Understanding Buck Power Stages in Switchmode Power Supplies", Application Report, Texas Instruments, Mixed Signal Products, Mar. 1999, pp. 1-32.
Bellcomb Technologies Incorporated, "Edges, Joiners, Attachments", Web Address: http://www.bellcomb.com/caps/edges.htm, Apr. 22, 2007, pp. 1-3.
Bookmarks Menu—Controllers/Wireless—Design Ideas, dated Dec. 6, 2012, 1 pg.
Bowling, S. "Buck-Boost LED Driver Using the PIC16F785 MCU", Microchip, AN1047, 2006, pp. 1-12.
By Staff, DALI Delivers Control and Cost Savings, Headaches Too, Consulting-Specifying Engineer, Jun. 2002, 2 pages.
Canny, D. "Controlling slew times tames EMI in offline supplies", EDN Design Ideas, Nov. 14, 2002.
Control Freak Addict Data Sheet, Copyright 2008, Creative Lighting, 5 pages.
Curtis, K. "High Power IR LED Driver Using the PIC16C781/782", Microchip, TB062, 2002, pp. 1-8.
CybroTech, Managing Lights with Dali, TN-012, rev 2, Cybrotech Ltd., 2007, 11 pgs.
Cypress Perform, Implementing an Integrated DMX512 Receiver, Item ID: 39762, Dec. 16, 2009, 1 pg.
Cypress Semiconductor Corporation, PowerPSoC (R) Intelligent LED Driver, Document No: 001-46319, Rev. G, 2009.
Davidovic, et al., Lead-Acid Battery Charger Becomes a Subfuction in a Microcontroller, The Authority on Emerging Technologies for Design Solutions, Mar. 2007, 2 pages.
Davmark Ltd., Dali-Protocol, 2007, 6 pages.
Di Jasio, "A Technique to Increase the Frequency Resolution of PICmicro MCU PWM Modules", Microchip, AN1050, 2006, pp. 1-10.
Dietz, et al. "Very Low-Cost Sensing and Communication Using Bidirectional LEDs", Mitsubishi Electric Research Laboratories, Jul. 2003, 19 pgs.
Distler, T. "LED Effects Stream TM v2.0 Protocol (Revision C)", Jun. 2, 2005, pp. 1-5.
Dunn, J. "Matching MOSFET Drivers to MOSEFTs", Microchip, AN799, 2004, pp. 1-10.
Fosler, R. "The RS-232/DALI Bridge Interface", Microchip, AN811, 2002, pp. 1-8.
Fosler, R. "Use a microcontroller to design a boost converter", EDN design ideas, Mar. 4, 2004, pp. 74-75.
Fosler, R., et al. "Digitally Addressable DALI Dimming Ballast", Microchip, AN809, 2002, pp. 1-18.
Ghulyani, L. "Simple MPPT-Based Lead Acid Charger Using bq2031", Texas Instruments, Dec. 2009, pp. 1-5.
Google Search Results for dali query group, search completed on Apr. 8, 2010, accessed at google.com, http://www.google.com/search?hl=en&c1ient=firefox-a&rls=org.mozilla:en-, 2 pages.
Hexcel Composites, "Sandwich Panel Fabrication Technology", Web Address: http://www.hexcel.com/NR/rdonlyres/B4574C2C-0644-43AC-96E2-CC15967A4b)5/4547 Sandwich Fabrication.pdf, Jan. 1997, pp. 1-16.
High-Side Current Monitor, ZETEX, Apr. 2001, ZXCT1009, Issue 3, pp. 1-8.
Implementing Infrared Object Detection, http://web.archive.org/web/20080528042614rejwww.seattlerobotics.org/guide/infrared.html, original publication date unknown, retrieved Apr. 7, 2010, seattlerobotics.org, 4 pages.
Jackson, S. "Circuit protects bus from 5V swings", EDN Design Ideas, Nov. 14, 2002.
Klepin, K. "Temperature Compensation for High Brightness LEDs using EZ-Color (TM) and PSoC Express", Cypress Perform, AN14406, Aug. 10, 2007, pp. 1-4.
Kremin, V. et al. "Multichannel LED Dimmer with CapSense Control—AN13943", Cypress Perform, Jul. 20, 2007.
Kropf, B. "Firmware—RGB Color Mixing Firmware for EZ-Color (TM)—AN16035", Cypress Perform, Jun. 13, 2007, pp. 1-7.
Lager, A. "Use a 555 timer as a switch-mode power supply", EDN Design Ideas, Nov. 14, 2002.
Lee, M. Shunt Battery Charger Provides 1A Continuous Current, EDN Magazine, 1997.
Locher, R. "Introduction to Power MOSEFETs and their Applications", Fairchild Semiconductor (TM), Application Note 558, Rev B, Oct. 1998, 15 pgs.
Miller, R. "Digital addressable lighting interface protocol fosters systems interoperability for lower costs and greater design flexibility", RNM Engineering, Inc., Apr. 2003, pp. 1-20.
Nell, S. "VCO uses programmable logic", EDN Design Ideas, Nov. 14, 2002.
News & Events DALI Digital addressable lighting interface lamp luminaire control, accessed at http://www.dali-ag.org/ on Apr. 8, 2010, original publication date unknown, updated Apr. 8, 2010, 1 pg.
O'Loughlin, M. "350-W, Two-Phase Interleaved PFC Pre-regulator Design Review", Texas Instruments, Application Report, Revised Mar. 2007, pp. 1-.
O'Loughlin, M., PFC Pre-Regulator Frequency Dithering Circuit, Texas Instruments, May 2007, pp. 1-8.
Perrin, R. Inexpensive Relays Form Digital Potentiometer, EDN Design Ideas, 1998, 2 pages.
Petersen, A. "Harness solar power with smart power-conversion techniques", EDN, Green Electronics designfeature, Feb. 4, 1999, pp. 119-124.
Prendergast, P. "How to Design a Three-Channel LED Driver", Cypress Perform, Jan. 2008, pp. 1-9.
Renesas, R8C/25 Demonstration Example for DALI Lighting Protocol Stack, REU05B0077-0100/Rev. 1.00, Jul. 2008, 14 pgs.
Richardson, C., Matching Driver to LED, National Semiconductor, Jan. 2008, 5 pgs.
Richardson. C., LM3404 Driving a Seoul Semi Zpower P4 1A LED-RD-134, National Semiconductor, Apr. 2007, 6 pages.
Software Design Specification, Z-Wave Protocol Overview, Z wave the wireless language, Zensys A/S, May 9, 2007, pp. 1-16.
Soundlight, Operating Manual, DALI and DMX Dekoder 7064A-H Mk1, 2008, 8 pgs.
Takahashi A., Methods and Features of LED Drivers, National Semiconductor, Mar. 2008, 3 pgs.
Universal Powerline Bus Communication Technology, Overview, PCS Powerline Control Systems UPB (Universal Powerline Bus), Jan. 8, 2002, pp. 1-13.
UPB Technology Description, PCS—Powerline Control Systems, UPB (Universal Powerline Bus), Version 1.4, Apr. 16, 2007, 68 pages.

(56) References Cited

OTHER PUBLICATIONS

Van Dorsten, Arian, A Low Cost Step-up Converter by IC 555, posted Jul. 21, 2007, http://www.eleccircuit.comla-low-cost-step-up-converter-by-ic-5551, retrieved Apr. 7, 2010, 2 pages.
Walma, K., DALI: Forerunner of Today's Breakthrough Lighting Technology, Feb. 2007, 2 pages.
Wikipedia, Digital Addressable Lighting Interface, original publication date unknown, Retrieved from:Retrieved from "http://en.wikipedia.org/wikiJDigital_Addressable_Lighting_Interface" accessed on Apr. 8, 2010, 3 pages.
Wojslaw, C. "DPP adds versatility to VFC", EDN, design ideas, Nov. 14, 2002, pp. 99-110.
Young, R. "Power circuit terminates DDR DRAMs", EDN Design Ideas, Nov. 14, 2002.
Zarr, R. Driving High-Power LEDs, Machine Design, Oct. 2007, 3 pages.
Zensys ASCII Interface, VIZIA, 2007.

* cited by examiner

SYSTEMS AND METHODS FOR CONNECTOR ENABLING VERTICAL REMOVAL

BACKGROUND

Devices and systems, such as lighting systems, are being integrated into a variety of different settings and environments that may require a number of independent units working in concert. Such systems may be exposed to a number of natural elements, such as rain, snow, heat, cold humidity, water or wind. These and other natural elements may cause problems and even malfunctions of lighting units which may include electronic and/or electrical components. Short circuit contacts may be caused by water or humidity which may destroy the electronic components such as switches or processors, thus decreasing the life span of the lighting fixtures and increasing the maintenance cost.

SUMMARY

In view of the advanced circuitry sometimes associated with such systems, the versatility of use and location, and the volume requirements, it is becoming increasingly important to facilitate ease of maintenance, repair, or replacement of components integrated into such systems. The inventors have appreciated that an apparatus may be provided to facilitate easily electrically connecting and disconnecting a plurality of electrical fixtures, such as light fixtures for light emitting diodes, together. In view of the foregoing, the present disclosure is directed to methods and apparatuses for permitting such connections.

One exemplary inventive embodiment provides an apparatus for serially and removably connecting a plurality of fixtures. The apparatus includes a connector housing having a mounting surface, a first set of electrical contacts, a second set of electrical contacts, and a plurality of conducting members extending from the first set of electrical contacts to the second set of electrical contacts. The first set of electrical contacts are positioned, at least in part, in the connector housing and the first set of electrical contacts extend in a direction having an orthogonal component with respect to the mounting surface. The second set of electrical contacts are also positioned, at least in part, in the connector housing, and the second set of electrical contacts extend in a direction having an orthogonal component with respect to the mounting surface. Accordingly, a first fixture may be removably connected to the first set of electrical contacts and may thereby serially electrically communicate with a second fixture removably connected to the second set of electrical contacts.

The fixture may be a light fixture and may be a light emitting diode light fixture. The first electrical fixture may include an electrical connection configured to receive electrical power from an electrical power source. The electrical connection may include an electrical cord, cable, plug, or a socket.

The first electrical fixture may include an electrical connection configured to receive electrical power from an electrical power source.

In accordance with various embodiments, the second set of electrical contacts extends in the same direction.

The mounting surface is disposed in a plurality of planes and the first set of electrical contacts and the second set of electrical contacts extend in distinct directions, in accordance with some embodiments. The plurality of planes may include a first plane and a second plane orthogonal to the first plane.

The first set of electrical contacts may extend from an input printed circuit board assembly positioned, at least in part, in the connector housing and the second set of electrical contacts may extend from an output printed circuit board assembly positioned, at least in part in the connector housing.

In various embodiments, the plurality of conductive members is positioned within the connector housing.

The connector housing may be composed of a material having an electrically insulating property.

The first set of electrical contacts may include a male contact configured to mate with a female contact on the first light fixture and the second set of electrical contacts may include a female contact configured to mate with a male contact on the second light fixture.

The plurality of conductive members includes jumper wires, in accordance with various embodiments. The jumper wires may be electrically connected with a first printed circuit board assembly positioned in the connector housing from which the first set of electrical contacts extend and the jumper wires may further be electrically connected with a second printed circuit board assembly positioned in the connector housing from which the second set of electrical contacts extend.

In some embodiments, the plurality of conductive members includes wire traces.

The first set of electrical contacts and the second set of electrical contacts may include blade type contacts. The first set of electrical contacts and the second set of electrical contacts may include circular spring contacts.

In some embodiments, the apparatus includes at least one gasket positioned around at least one of the first set of electrical contacts and the second set of electrical contacts.

The connector housing may include a region positioned between the first set of electrical contacts and the second set of electrical contacts. The region on the connector housing may be contoured to correspond to a region on the first light fixture and the second light fixture.

In various embodiments, each of the first set of electrical contacts and the second set of electrical contacts includes at least four electrical contacts.

In various embodiments, the first set of electrical contacts includes distinct electrical contacts and the second set of electrical contacts includes distinct electrical contacts.

The first set of electrical contacts has a polarity distinct from the polarity of the second set of electrical contacts, in various embodiments.

The connector housing may include holes adapted to receive fasteners for coupling the connector housing to a supporting surface, such that the mounting surface engages the supporting surface. The supporting surface may include a wall. The supporting surface may include a ceiling. The supporting surface may include a bracket. The mounting surface may include an adhesive for coupling the connector housing to a surface.

In various embodiments, the first set of electrical contacts and the second set of electrical contacts extend from the connector housing.

Another exemplary inventive embodiment provides an apparatus for serially and removably connecting a plurality of light fixtures. The apparatus includes a connector housing, a first set of electrical contacts positioned, at least in part in the connector housing, a second set of electrical contacts positioned, at least in part, in the connector housing. The first set of electrical contacts extends in a direction having an orthogonal component with respect to a first surface of the connector housing. The second set of electrical contacts extends in the direction having the orthogonal component with respect to the first surface of the connector housing. The apparatus further includes a plurality of conductive members extending from the first set of electrical contacts to the second set of electrical contacts, such that a first light fixture removably connected to the first set of electrical contacts is in serial electrical communication with a second light fixture removably connected to the second set of electrical contacts.

Another exemplary inventive embodiment provides an apparatus for serially and removably connecting a plurality of light fixtures that includes a bracket having a rotatable component, the rotatable component configured for rotation about an axis. The apparatus further includes a connector housing configured for coupling to the rotatable component of the bracket, such that the connector housing is rotatable with respect to the bracket with the rotatable component about the axis. The apparatus also includes a first set of electrical contacts positioned, at least in part, in the connector housing. The first set of electrical contacts extends in a first direction having an orthogonal component with respect to the axis of rotation. The apparatus also includes a second set of electrical contacts positioned, at least in part, in the connector housing. The second set of electrical contacts extends in a second direction having an orthogonal component with respect to the axis of rotation. The apparatus includes yet further a plurality of conductive members extending from the first set of electrical contacts to the second set of electrical contacts such that a first light fixture removably connected to the first set of contacts is in electrical communication with a second light fixture removably connected to the second set of contacts. The first direction and the second direction may be the same. The first direction and the second direction may include distinct directions. The connector housing may include a mounting region contoured to correspond to a region on the bracket. The mounting region may include a channel.

Another exemplary inventive embodiment provides a method of serially and removably connecting a plurality of light fixtures. The method includes mounting a jumper block to a first surface. The jumper block includes a first set of electrical contacts positioned, at least in part, in the jumper block, second set of electrical contacts positioned, at least in part, in the jumper block, and a plurality of conductive members extending from the first set of electrical contacts to the second set of electrical contacts. The first set of electrical contacts extends in a direction having an orthogonal component with respect to a first surface of the jumper block. The second set of electrical contacts extends in the direction having the orthogonal component with respect to the first surface of the jumper block. The method also includes moving a first light fixture in a direction co-axial with the first set of electrical contacts and thereby connecting the first light fixture to the first set of electrical contacts and moving a second light fixture in a direction co-axial with the second set of electrical contacts and thereby connecting the second light fixture to the second set of electrical contacts, such that the first light fixture is serially in electrical communication with the second light fixture.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

The features and advantages of the inventive embodiments will become more apparent from the detailed description set forth below when taken in conjunction with the drawings.

DETAILED DESCRIPTION

Following below are more detailed descriptions of various concepts related to, and embodiments of, inventive systems, methods and apparatus for serially and removably connecting a plurality of fixtures, such as light fixtures. It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

Figure 1:
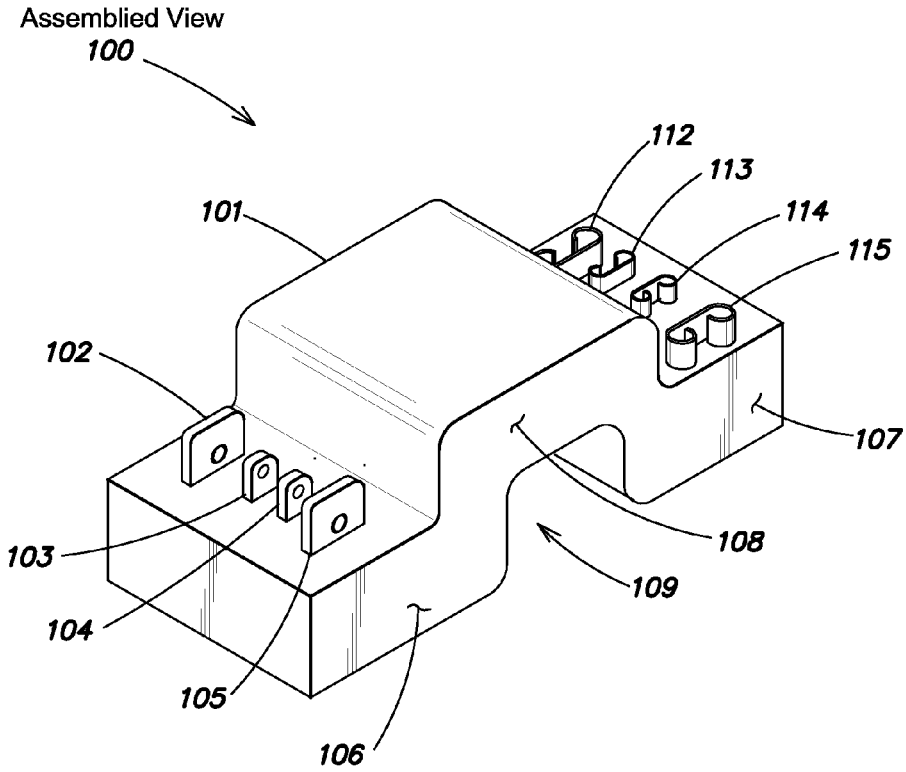
FIG. 1 shows a perspective view of an apparatus for serially and removably connecting a plurality of fixtures, in accordance with one inventive embodiment.

FIG. 1 shows a perspective view of an apparatus for serially and removably connecting a plurality of fixtures, in accordance with one inventive embodiment. Connecting apparatus 100 includes a connector housing 101, which housing generally includes two distinct regions 106 and 107. Housing 101 may be composed of a variety of materials in accordance with inventive embodiments, which include but are not limited to, plastic, composites, rubber, polymers, and metals; however, the housing will generally be composed of a non-conductive material. Region 106 of housing 101 is the region in the housing from which a first set of electrical contacts extends. In the illustrated embodiment, region 106 includes input electrical contacts 102-105. Region 107 of housing 101 is the region in the housing from which a second set of electrical contacts extends. In the illustrated embodiment, region 107 includes output electrical contacts 112-115. Input contacts 102-105 receive the output electrical signals from a first electrical fixture, such as light fixture connected thereto and transmit the electrical signals to output electrical contacts 112-115, which transmit the signal to input electrical contacts on a second light fixture. Electrical contacts 102-105 are depicted as male blade type contacts in the illustrated embodiment, but may include a variety of contact types, such as circular spring contacts, in accordance with various embodiments. Electrical contacts 112 through 115 are illustrated as female blade type contacts in the illustrated embodiment, but like contacts 102-105 may also include a variety of contact types in accordance with various inventive embodiments. Similarly, contacts 102-105 and 112-115 may include different styles of contacts, which may be tailored to correspond with the contacts with which contacts 102-105 or 112-115 will connect with on an associated electrical fixture. As further illustrated, contacts 102-105 may include a variety of contacts within the set. By way of example only, contact 102 has a distinct geometry from contact 103. In some embodiments, contacts 102-105 may all be the same. Additionally, various embodiments may have more than four input contacts or less than four input contacts. Accordingly, the connecting apparatus 100 is configured to electrically connect two fixtures, such as light emitting diode fixtures. In some embodiments, the connecting apparatus may include a region to further facilitate mating or engaging with light fixtures such as region 108. Region 108 may include a raised flat with which a portion of one or more connected fixtures may contact as will be illustrated herein. Additionally, such a region may form a void 109 to facilitate engagement of the connecting apparatus with a bracket.

Figure 2:
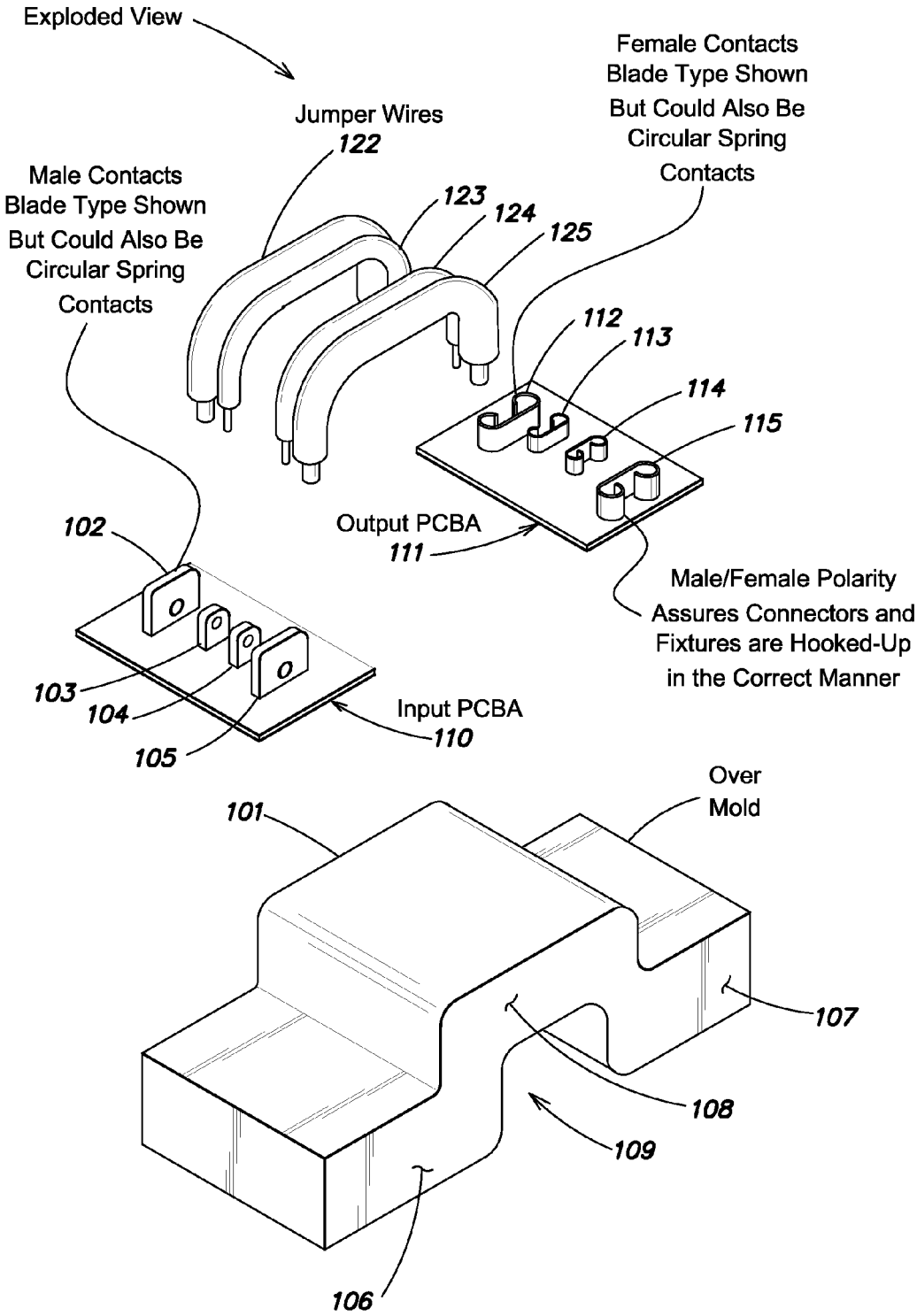
FIG. 2 provides an exploded view of the embodiment depicted in FIG. 1.

FIG. 2 provides an exploded view of the embodiment depicted in FIG. 1. FIG. 2 illustrates additional components which may be housed in connector housing 101 in accordance with various inventive embodiments. As exemplarily, demonstrated in FIG. 2, electrical contacts 102-105 may be connected to a printed circuit board 110. Similarly, electrical contact 112-115 may be connected to a printed circuit board 111. A plurality of conductive members, such as jumper wires 122-125 may extend from board 110 to board 111 through region 108 of connector and jumper wires 122-125 may thereby be used to connect contacts 102-105 with contacts 112-115 respectively.

Figure 3:
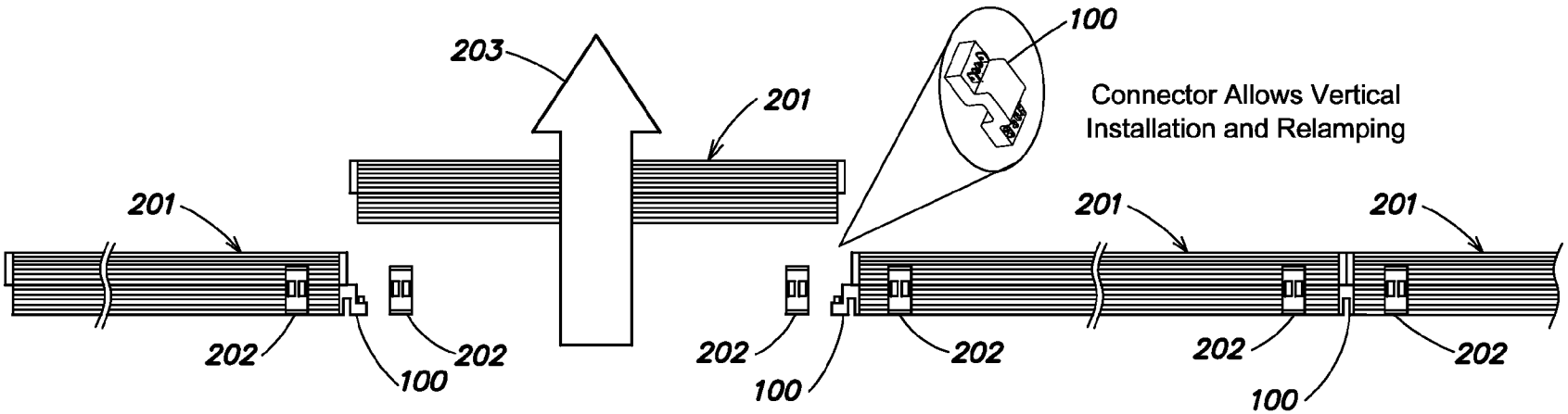
FIG. 3 illustrates a front view of a plurality of light fixtures connected by a connector, in accordance with one inventive embodiment.

FIG. 3 illustrates a front view of a plurality of light fixtures connected by a connector, in accordance with one inventive embodiment. As, illustrated in FIG. 3, light fixtures 201, particularly light fixtures configured to transmit light generated by light emitting diodes, may be serially connected by a plurality of connecting apparatuses 100. The light fixtures 201 are generally configured for electrical connection to apparatuses 100 near extremities of each fixture. The light fixtures may be connected by connecting apparatuses 100 in concert with the apparatuses being mounted by a primary and distinct mounting bracket 202. In various inventive embodiments, connecting apparatuses 100 may be configured as the mounting bracket in addition to facilitating the electrical connection between fixtures. As further demonstrated in FIG. 3, being serially connected via connecting apparatuses 100, permits the lighting fixtures to be removed via extraction in the direction of arrow 203, which direction may be vertical in various embodiments and is generally orthogonal to an associated mounting surface, which surface may include a surface on the bracket, or on a wall, ceiling, cove or other surface on which the lighting fixture is mounted.

Figure 4:
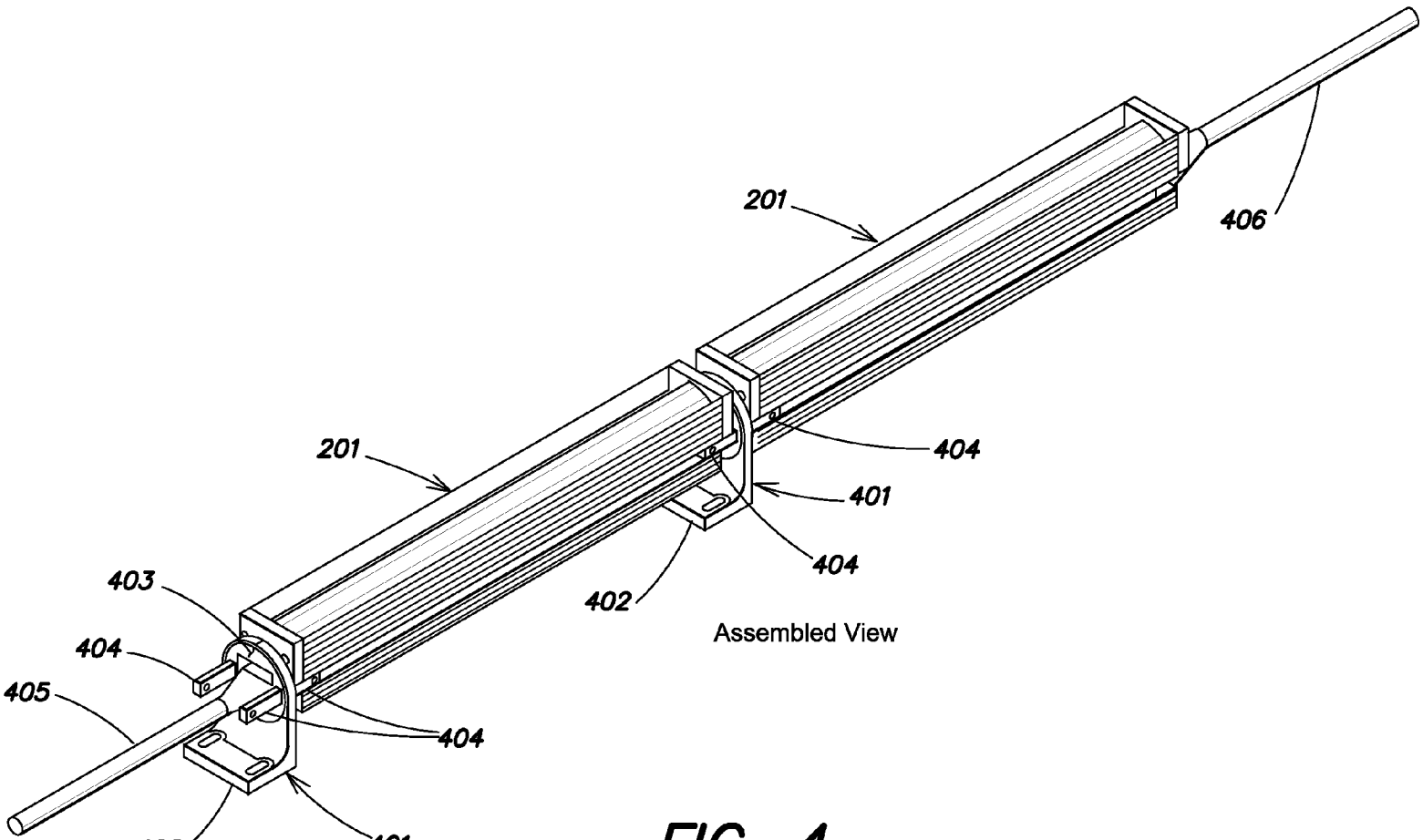
FIG. 4 provides a perspective view of a plurality of light fixtures connected by a connector integrated with a rotatable bracket, in accordance with one inventive embodiment.
Figure 5:
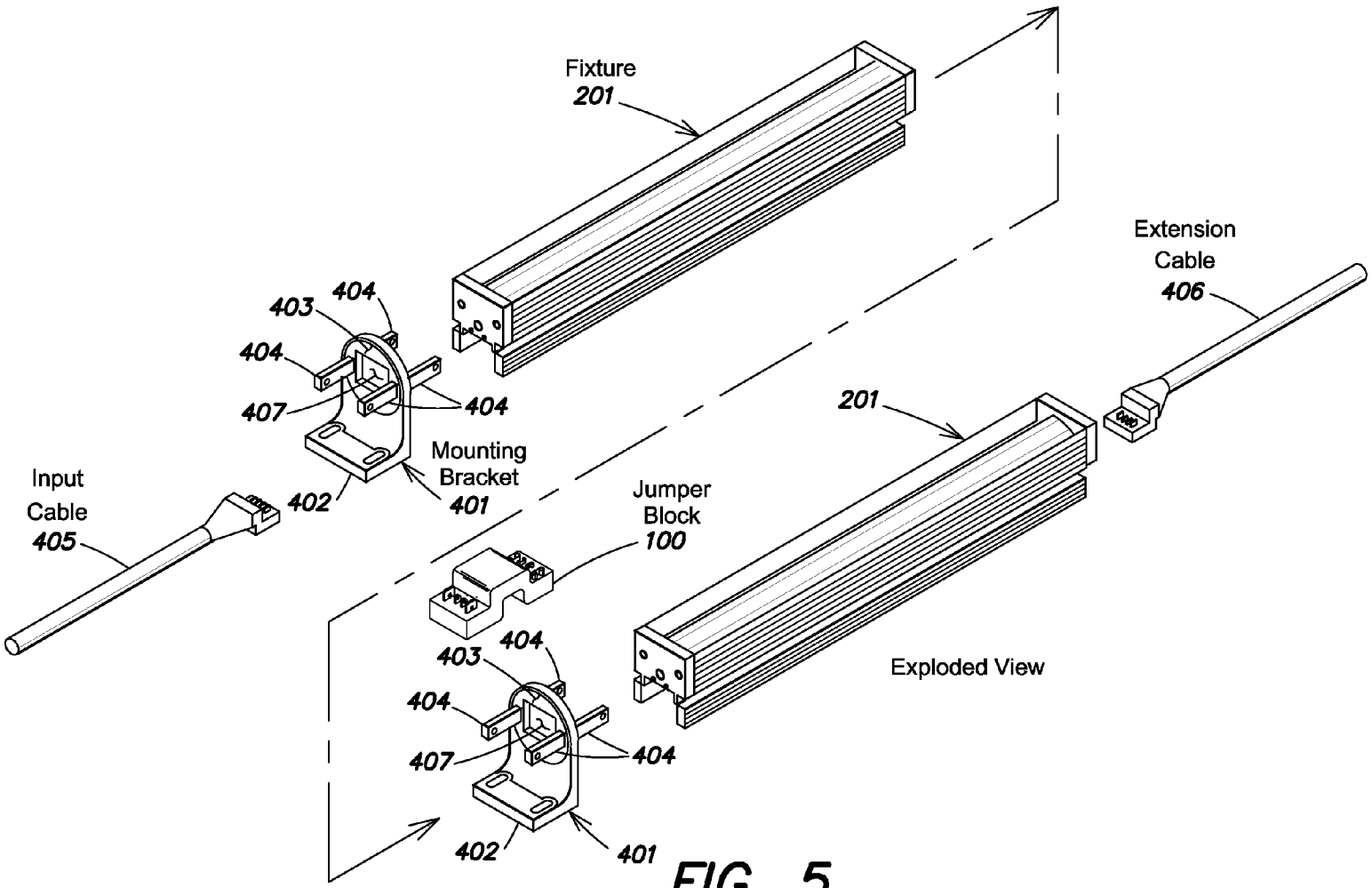
FIG. 5 provides an exploded view of the inventive embodiment depicted in FIG. 4.

FIG. 4 provides a perspective view of a plurality of light fixtures connected by a connector integrated with a rotatable bracket, in accordance with one inventive embodiment. FIG. 5 provides an exploded view of the inventive embodiment depicted in FIG. 4. As demonstrated in FIGS. 4 and 5, connecting apparatuses 100 permit light fixtures 201 to be connected when mounted in a variety of configurations, including when mounted by rotatable brackets 401. Brackets 401 include a wall mounting portion 402 and a rotatable bearing 403. Bearing 403 includes mounting stems 404, which facilitate connecting the light fixtures 201 to bracket 401. In some embodiments stems 404 may also be configured to connect to connecting apparatuses 100. As more clearly seen in FIG. 5, bearing 403 includes an aperture 407. Connecting apparatus 100 may be positioned in the aperture to connect a light fixture 201 disposed on a first side of the bracket with a light fixture 201 disposed on a second side of the bracket. Similarly an input cable 405 may connect to an input contact on a light fixture by extending through aperture 407 and similarly an output cable 406 may connect to an output contact on a light fixture by extending through aperture 407 on another bracket 401.

Figure 6:
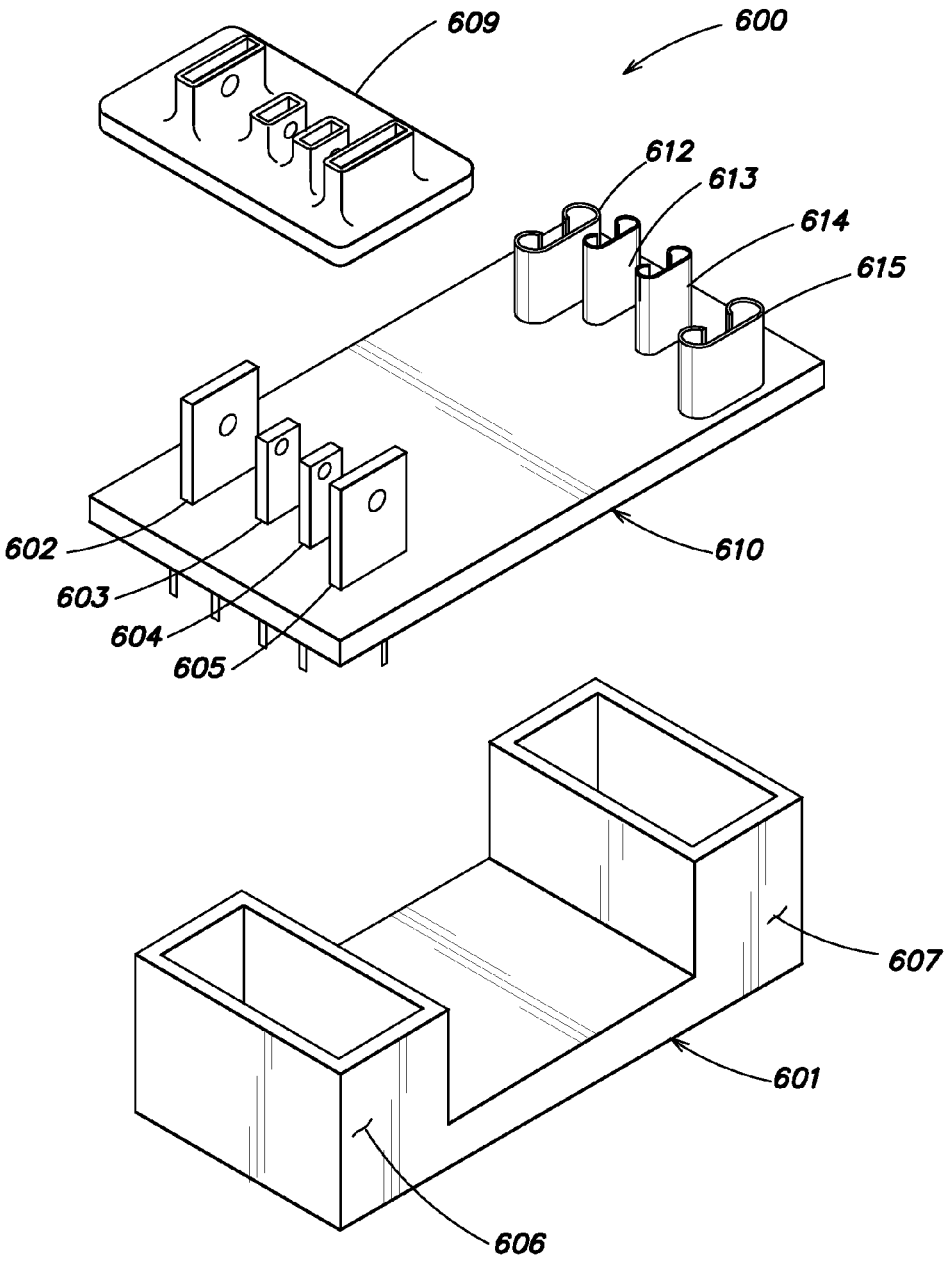
FIG. 6 illustrates an exploded view of an apparatus for serially and removably connecting a plurality of fixtures, in accordance with another inventive embodiment.

FIG. 6 illustrates an exploded view of an apparatus for serially and removably connecting a plurality of fixtures, in accordance with another inventive embodiment. Connecting apparatus 600, depicted in FIG. 6 includes a housing 601, which is distinct from the embodiment depicted in FIGS. 1-5. Housing 601 includes a region 606 configured to house input contacts 602 through 605 and a region 607 configured to house output contacts 612-615. Contacts 602-605 and 612-615 are connected to printed circuit board 610, which when positioned in housing 601 extends through the base of the housing from region 606 to region 607. Printed circuit board 610 may include a plurality of distinct traces extending, for example from contact 602 to contact 612. As further depicted in the embodiment illustrated in FIG. 6, the housing may include additional components such as grommet 609, which may include a plurality of apertures through which electrical contacts such as contacts 602-605 may extend. The grommet may be shaped and composed of a material which facilitates preventing water or other substances from entering into housing 601.

Figure 7:
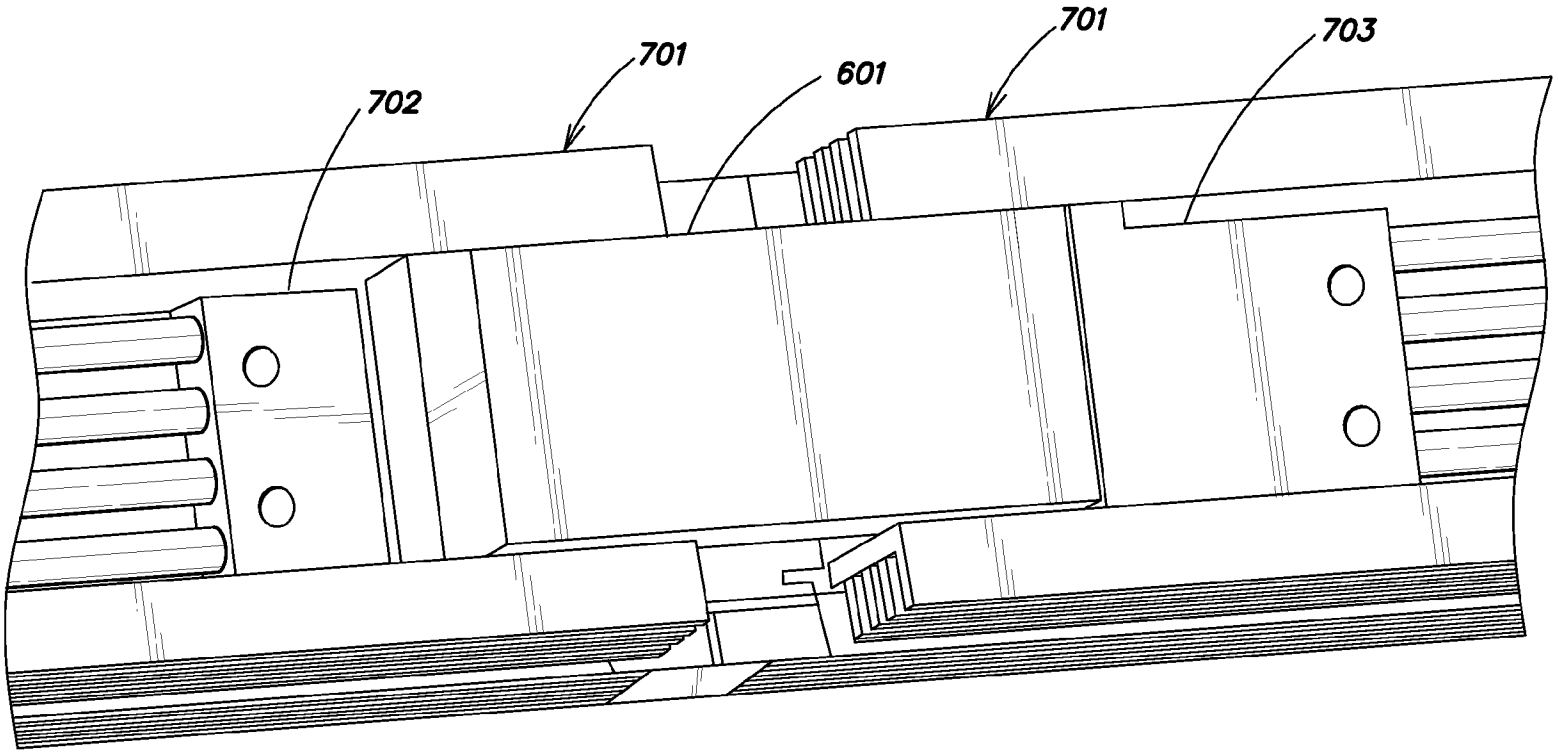
FIG. 7 illustrates two light fixtures connected via the connecting apparatus of FIG. 6.

FIG. 7 illustrates two light fixtures connected via the connecting apparatus of FIG. 6. FIG. 7 illustrates the bottom side of housing 601 and further depicts connecting apparatus 600 connecting two light fixtures 701. As illustrated connecting apparatus 601 is connected to an output 702 of a first fixture 701 and to the input 703 of a second fixture 701.

Figure 8:
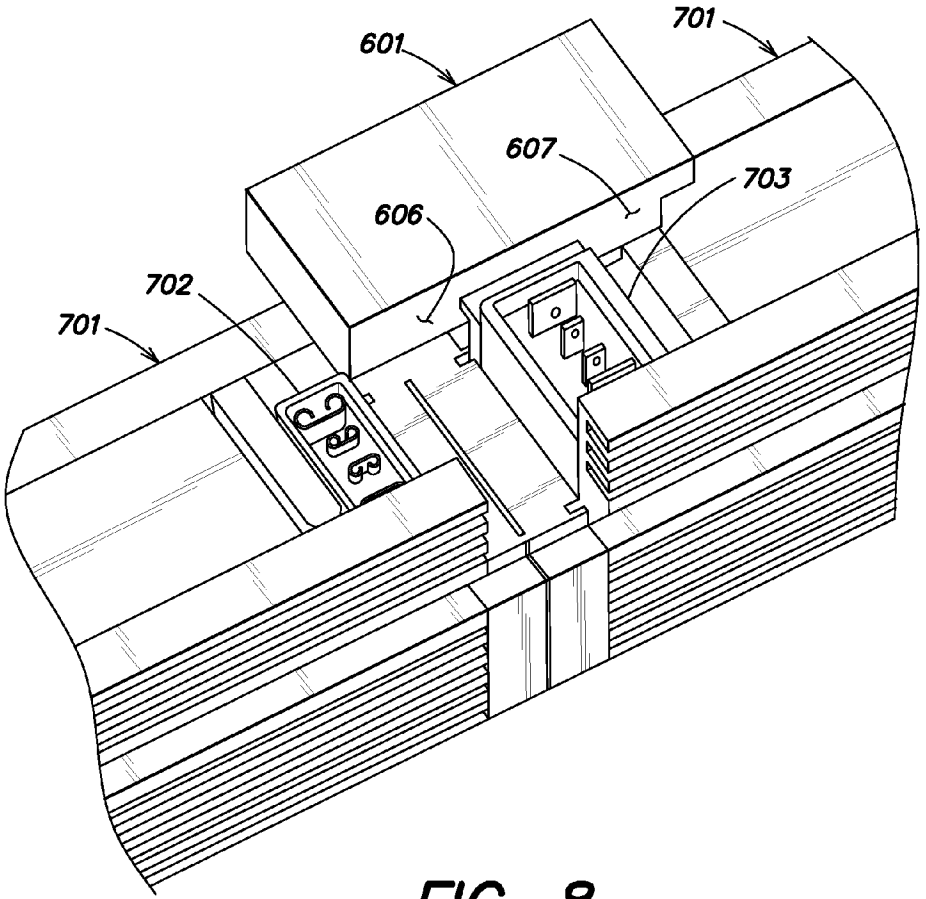
FIG. 8 provides an exploded bottom view of the two light fixtures and connecting apparatus shown in FIG. 7.

FIG. 8 provides an exploded bottom view of the two light fixtures and connecting apparatus shown in FIG. 7. As further demonstrated in FIG. 8, output 702 includes female blade type contacts to facilitate mating engagement with male blade type contacts 602-605 of connecting apparatus 600. Similarly, input 703 includes male blade type contacts to facilitate mating engagement with female blade type contacts 612-615 of connecting apparatus 600. Although not depicted, each fixture 701 includes an input 702 on a first end and an output 703 on a second end.

Figure 9:
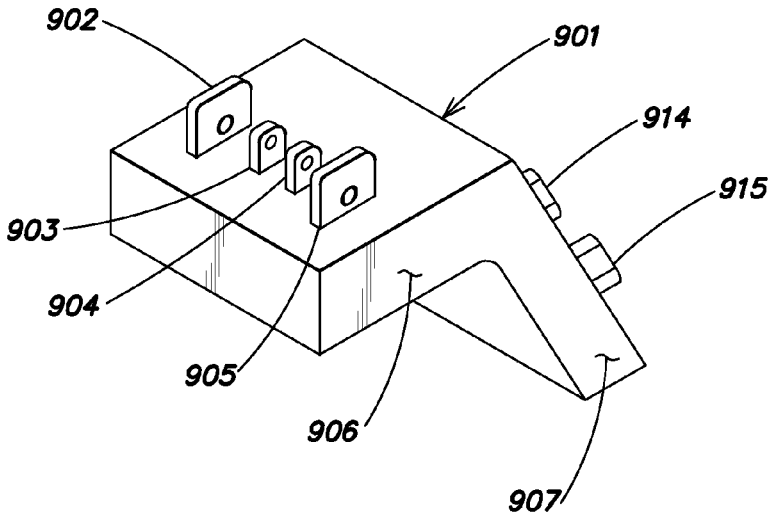
FIG. 9 illustrates a connector that permits connection of lights around or within a corner in accordance with one inventive embodiment.

FIG. 9 illustrates a connector that permits connection of lights around or within a corner in accordance with one inventive embodiment. As shown in FIG. 9, housing 901 includes a first region 906 includes input contacts 902-905, which may be disposed in a different plane than region 907 that includes output contacts 912-915. More specifically, region 906 may be disposed in an orthogonal plane to region 907 to facilitate connecting a first light fixture disposed on a first side of a building with a light fixture disposed on a second side of a building or simply to facilitate lights not positioned in a straight line.

Figure 10:
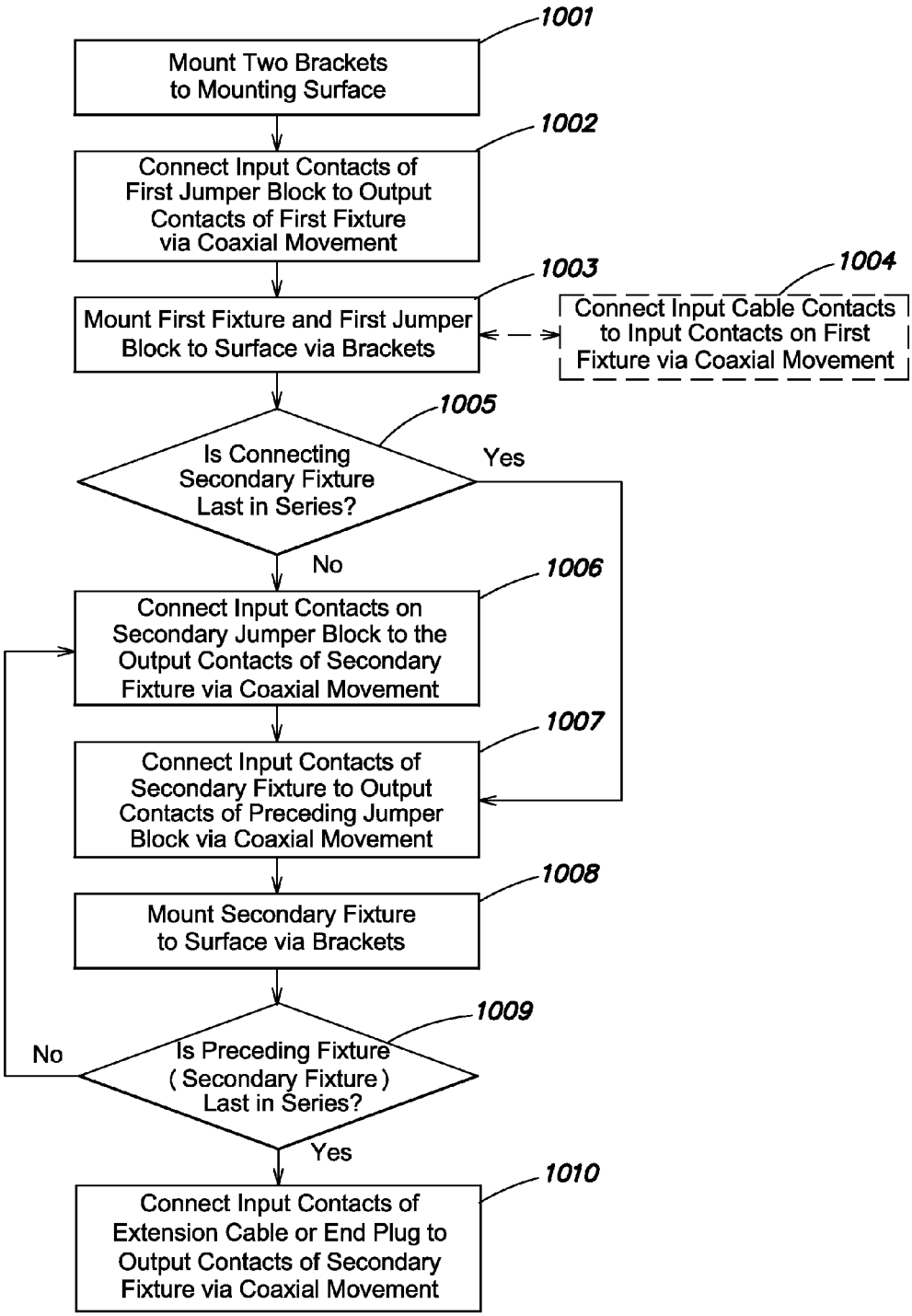
FIG. 10 provides a flow chart depicting an exemplary process for serially connecting a plurality of fixtures in accordance with one inventive embodiment.

FIG. 10 provides a flow chart depicting an exemplary process for serially connecting a plurality of fixtures in accordance with one inventive embodiment. In step 1001, one or more brackets are mounted to a mounting surface to which fixtures, such as light fixtures will be mounted. The surface may include a ceiling, an internal or external wall, a roof, a cove formed on or in a wall, etc. In step 1002, the input contacts of a first jumper block or connecting apparatus are connected to the output contacts of a first fixture via co-axial movement. More specifically, the jumper block includes a first set of electrical contacts and a second set of electrical contacts, each of which extend in a direction having an orthogonal component with respect to a first surface of the jumper block. The light fixture is moved coaxially, with respect to an axis extending along the direction of extension of the first and second set of electrical contacts, to removably couple the first set of electrical contacts of the jumper block, the input contacts of the jumper block, with the output contacts of the first fixture. Once a jumper block is connected to the first fixture, the fixture may be mounted to the surface in step 1003 via one or more of the brackets installed in step 1001. The mounted fixture may also be connected to a power source in step 1004. However this connection could be made at an earlier or later stage in the overall process, in accordance with various embodiments. Once a first fixture is mounted and connected to a first jumper block a second fixture may be serially connected to the first fixture via the first jumper block. As demonstrated in analysis step 1005, if the secondary fixture being connected to the first fixture is not the last in the series, a secondary jumper block may be connected to the output contacts of the secondary fixture in step 1006 to facilitate connecting a third, fourth, or nth fixture to the series of fixtures. If the secondary, third, fourth, or nth fixture being connected is the last in the series, installation may proceed directly to step 1007, where the secondary fixture (or nth fixture) is connected to the first (or preceding) jumper block for connection to the first (or preceding) jumper block. In step, 1007, when the input contacts of the secondary fixture are connected to the output contacts of the first jumper block, the connection made via co-axial movement of the fixture contacts with respect to the electrical contacts of the jumper block. As such, when a plurality of fixtures are connected and mounted to a surface, removal (and re-insertion) of any of the fixtures may be achieved by an axial motion of any of the fixtures, as demonstrated previously herein in FIG. 3. Once the secondary fixture is mounted to the primary jumper block, it may also be secured to the surface via a bracket in step 1008. If the fixture mounted in step 1008, is the last fixture in the series, the output of the fixture may be connected to an output cord to complete the circuit of the plurality of coupled fixtures, via step 1010. If the fixture is not the last in the series, and subsequently has had a secondary (or nth) jumper block connected to its output contacts in step 1006, another fixture may be connected to that fixture via the secondary (or nth) jumper block connected to it and the installation cycle will repeat until a last fixture is connected to the series.

As noted above, the process demonstrated in FIG. 10 is exemplary and is non-exhaustive of inventive embodiments encompassed by the present disclosure. Other embodiments provide other installation methods, which facilitate the coaxial coupling and removal of the jumper block with fixtures. For example, in some embodiments, a plurality of fixtures may be completely mounted and once mounted may be coupled by a jumper block axially inserted to connect two adjacent fixtures. In such an embodiment, removal of the fixtures includes removal of a jumper block before or in concert with removal of the fixture, but may still be achieved by the sole axial motion in the direction demonstrated in FIG. 3. Additionally, as previously disclosed, in some embodiments, the jumper block may serve the dual purpose of facilitating the connection and providing support as a mounting bracket. In such embodiments, the jumper block may be mounted to the mounting surface and subsequently connected with the fixture via co-axial movement and alignment of the respective electrical contacts on the block and the fixture.

All literature and similar material cited in this application, including, but not limited to, patents, patent applications, articles, books, treatises, and web pages, regardless of the format of such literature and similar materials, are expressly incorporated by reference in their entirety. In the event that one or more of the incorporated literature and similar materials differs from or contradicts this application, including but not limited to defined terms, term usage, described techniques, or the like, this application controls.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments of the invention can be implemented in any of numerous ways. For example, some embodiments may be implemented using hardware, software or a combination thereof. When any aspect of an embodiment is implemented at least in part in software, the software code can be executed on any suitable processor or collection of processors, whether provided in a single computer or distributed among multiple computers.

In this respect, various aspects of the invention may be embodied at least in part as a computer readable storage medium (or multiple computer readable storage media) (e.g., a computer memory, one or more floppy discs, compact discs, optical discs, magnetic tapes, flash memories, circuit configurations in Field Programmable Gate Arrays or other semiconductor devices, or other tangible computer storage medium or non-transitory medium) encoded with one or more programs that, when executed on one or more computers or other processors, perform methods that implement the various embodiments of the technology discussed above. The computer readable medium or media can be transportable, such that the program or programs stored thereon can be loaded onto one or more different computers or other processors to implement various aspects of the present technology as discussed above.

The terms "program" or "software" are used herein in a generic sense to refer to any type of computer code or set of computer-executable instructions that can be employed to program a computer or other processor to implement various aspects of the present technology as discussed above. Additionally, it should be appreciated that according to one aspect of this embodiment, one or more computer programs that when executed perform methods of the present technology need not reside on a single computer or processor, but may be distributed in a modular fashion amongst a number of different computers or processors to implement various aspects of the present technology.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, the technology described herein may be embodied as a method, of which at least one example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

The invention claimed is:

1. An apparatus for serially and removably connecting a plurality of light fixtures, the apparatus comprising:

a connector housing having a mounting surface;

a first set of electrical contacts positioned, at least in part, in the connector housing, the first set of electrical contacts extending in a direction having an orthogonal component with respect to the mounting surface;

a second set of electrical contacts positioned, at least in part, in the connector housing, the second set of electrical contacts extending in a direction having an orthogonal component with respect to the mounting surface; and a plurality of conductive members extending from the first set of electrical contacts to the second set of electrical contacts, such that a first light fixture removably connected to the first set of electrical contacts is in serial electrical communication with a second light fixture removably connected to the second set of electrical contacts, wherein the first light fixture and the second light fixture each includes a light emitting diode.

2. The apparatus of claim 1, wherein the first electrical fixture includes an electrical connection configured to receive electrical power from an electrical power source.

3. The apparatus of claim 1, wherein the first set of electrical contacts and the second set of electrical contacts extend in the same direction.

4. The apparatus of claim 1, wherein the first set of electrical contacts extend from an input printed circuit board assembly positioned, at least in part, in the connector housing and wherein the second set of electrical contacts extends from an output printed circuit board assembly positioned, at least in part in the connector housing.

5. The apparatus of claim 1, wherein the first set of electrical contacts includes a male contact configured to mate with a female contact on the first electrical fixture and the second set of electrical contacts includes a female contact configured to mate with a male contact on the second electrical fixture.

6. The apparatus of claim 1, wherein the plurality of conductive members includes jumper wires.

7. The apparatus of claim 6, wherein the jumper wires are electrically connected with a first printed circuit board assembly positioned in the connector housing from which the first set of electrical contacts extend and wherein the jumper wires are electrically connected with a second printed circuit board assembly positioned in the connector housing from which the second set of electrical contacts extend.

8. The apparatus of claim 1, wherein the connector housing includes a region positioned between the first set of electrical contacts and the second set of electrical contacts, the region on the connector housing contoured to correspond to a region on the first electrical fixture and the second electrical fixture.

9. The apparatus of claim 1, wherein the mounting surface is disposed in a plurality of planes and the first set of electrical contacts and the second set of electrical contacts extend in distinct directions.

10. The apparatus of claim 9, wherein the plurality of planes includes a first plane and a second plane orthogonal to the first plane.

11. An apparatus for serially and removably connecting a plurality of light fixtures, the apparatus comprising:

a connector housing;

a first set of electrical contacts positioned, at least in part, in the connector housing, the first set of electrical contacts extending in a direction having an orthogonal component with respect to a first surface of the connector housing;

a second set of electrical contacts positioned, at least in part, in the connector housing, the second set of electrical contacts extending in the direction having the orthogonal component with respect to the first surface of the connector housing;

a plurality of conductive members extending from the first set of electrical contacts to the second set of electrical contacts, such that a first light fixture removably connected to the first set of electrical contacts is in serial electrical communication with a second light fixture removably connected to the second set of electrical contacts; and wherein the first set of electrical contacts includes a male contact configured to mate with a female contact on the first electrical fixture and the second set of electrical contacts includes a female contact configured to mate with a male contact on the second electrical fixture.

12. An apparatus for serially and removably connecting a plurality of electrical fixtures, the apparatus comprising:

a connector housing having a mounting surface;

a first set of electrical contacts positioned, at least in part, in the connector housing, the first set of electrical contacts extending in a direction having an orthogonal component with respect to the mounting surface;

a second set of electrical contacts positioned, at least in part, in the connector housing, the second set of electrical contacts extending in a direction having an orthogonal component with respect to the mounting surface;

a plurality of conductive members extending from the first set of electrical contacts to the second set of electrical contacts, such that a first electrical fixture removably connected to the first set of electrical contacts is in serial electrical communication with a second electrical fixture removably connected to the second set of electrical contacts; and wherein the first set of electrical contacts extend from an input printed circuit board assembly positioned, at least in part, in the connector housing and wherein the second set of electrical contacts extends from an output printed circuit board assembly positioned, at least in part in the connector housing.

13. An apparatus for serially and removably connecting a plurality of electrical fixtures, the apparatus comprising:

a connector housing having a mounting surface;

a first set of electrical contacts positioned, at least in part, in the connector housing, the first set of electrical contacts extending in a direction having an orthogonal component with respect to the mounting surface;

a second set of electrical contacts positioned, at least in part, in the connector housing, the second set of electrical contacts extending in a direction having an orthogonal component with respect to the mounting surface;

a plurality of conductive members extending from the first set of electrical contacts to the second set of electrical contacts, such that a first electrical fixture removably connected to the first set of electrical contacts is in serial electrical communication with a second electrical fixture removably connected to the second set of electrical contacts;

wherein the plurality of conductive members includes jumper wire; and wherein the jumper wires are electrically connected with a first printed circuit board assembly positioned in the connector housing from which the first set of electrical contacts extend and wherein the jumper wires are electrically connected with a second printed circuit board assembly positioned in the connector housing from which the second set of electrical contacts extend.

* * * * *